United States Patent [19]
Ventker et al.
[11] 4,447,490
[45] May 8, 1984

[54] LAMINATED MINERAL FIBRE MAT AND PROCESSES FOR ITS PRODUCTION

[75] Inventors: Heinz Ventker, Emsdetten; Fred Wendlinger, Mannheim, both of Fed. Rep. of Germany

[73] Assignee: Rheinhold & Mahla Dammstoffe GmbH, Dusseldorf, Fed. Rep. of Germany

[21] Appl. No.: 444,918

[22] Filed: Nov. 26, 1982

[30] Foreign Application Priority Data

Nov. 28, 1981 [DE] Fed. Rep. of Germany ..... 3147316

[51] Int. Cl.[3] ..... B32B 5/08; B32B 5/14; B32B 5/24; B32B 17/06; B32B 33/00

[52] U.S. Cl. ..... 428/285; 156/82; 156/90; 156/155; 156/176; 156/276; 156/307.7; 156/324; 428/290; 428/302; 428/303; 428/920

[58] Field of Search ..... 156/82, 90, 155, 176, 156/276, 307.7, 324; 428/285, 290, 302, 303, 920

[56] References Cited

U.S. PATENT DOCUMENTS

| | | | |
|---|---|---|---|
| 2,566,619 | 9/1951 | Lyon et al. | 428/285 |
| 4,251,590 | 2/1981 | Rubright et al. | 428/285 |
| 4,310,585 | 1/1982 | Shannon | 428/920 |
| 4,381,330 | 4/1983 | Gotomyo et al. | 428/285 |

FOREIGN PATENT DOCUMENTS

| | | | |
|---|---|---|---|
| 52-68226 | 6/1977 | Japan | 428/285 |

*Primary Examiner*—James C. Cannon
*Attorney, Agent, or Firm*—Sprung, Horn, Kramer & Woods

[57] ABSTRACT

A laminated mineral fibre mat consisting of substantially randomly arranged mineral fibres which are held together by organic binders where they cross one another and which form the mat and of a lamination adhering to the mat by means of an organic adhesive, characterized in that a plane substantially free from organic binder is provided in the mat parallel to and in the vicinity of the lamination, whereby the laminated product is rendered fire resistant. The binder-free zone is created prior to lamination by removal of the binder from the mat.

10 Claims, 4 Drawing Figures

LAMINATED MINERAL FIBRE MAT AND PROCESSES FOR ITS PRODUCTION

Figure 1:
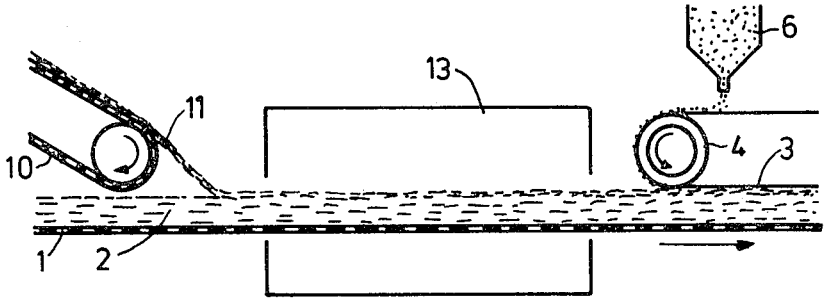

Mineral fibre mats are used, in particular, for heat insulation purposes in the building field or for insulating pipes, machines and the like in industry. In addition, mats of relatively high density are used for sound insulation.

The production of mineral fibre mats is generally based on a fiberizing process in which mineral fibres, between 1 and 20 cm in length result dispersed in an air stream. Immediately after the fiberizing process, the fibres are sprayed with a binder, generally a phenolic resin, and subsequently deposited on a conveyor belt. The binder is hardened by heat treatment. The mat receives its cohesion by the fact that the individual fibres are bonded with a binder where they cross one another.

Mineral fibre mats in the context of the invention are both flexible glass wool mats compressible to a fraction of their thickness and ranging from 15 to 80 kg/m$^3$ in density and dimensionally stable rock wool mats or panels ranging from 60 to 200 kg/m$^3$ in density.

Films or foils are bonded as lamination onto one or both sides of the mineral fibre mats, acting as vapour barriers. The films or foils are generally bonded by means or hot-melt adhesives, for example, polyethylene-based hot-melt adhesives, or tar-like adhesives.

Metal foils, particularly aluminum foils, have been successfully used for lamination.

One of the disadvantages of these known laminated mineral fibre boards lies in their poor burning behaviour.

In order to improve burning behaviour, it has already been proposed to apply the lamination by means of an adhesive based on waterglass (cf. for example DE-OS No. 24 60 509). Unfortunately, inorganic adhesives of the type in question are attended by the disadvantage that they have to be processed in aqueous dispersion and by the further disadvantage that the water released during setting or drying is very difficult to remove from the fibre mat. This is an insoluble problem, particularly in the case of mineral fibre panels laminated on both sides. In addition, inorganic adhesives of the type in question are inferior to organic adhesives in regard to the flexibility of the adhesive layer, adhesion to the lamination and fibres, sensitivity to moisture and the adverse effect of the alkaline component on the fibres.

Accordingly, the object of the present invention is to improve the burning behaviour of laminated mineral fibre mats where the lamination is applied by means of an organic adhesive. It has been found that the burning behaviour of laminated mineral fibre mats of the type in question is critically determined by the binder content of the mat in the immediate vicinity of the lamination. Burning behaviour can be considerably improved if the mat is kept substantially free from binder in that region.

Accordingly, the present invention relates to a laminated mineral fibre mat consisting of substantially randomly arranged mineral fibres which are held together by organic binders where they cross one another and which form the mat and of a lamination applied to the mat by means of an organic adhesive, characterised in that a plane substantially free from organic binder is provided in the mat parallel to and in the vicinity of the lamination. The plane free from organic binder should preferably be immediately adjacent the layer of adhesive holding the lamination. The thickness of the binder-free layer should amount to at least 2 mm and, preferably, to at least 4 mm. An upper limit to the thickness of the binder-free layer is imposed solely by the need to maintain the cohesion of the mat. Accordingly, the maximum thickness of the binder-free layer is determined by the lengths of the individual fibres forming the mat, by their arrangement and also by the process used to produce the mat.

The binder-free layer in the mat may be produced in different ways.

If the starting mat contains binder and if the binder is removed from that region in which the lamination is applied, the substantially binder-free zone can be made thicker because removal of the binder leaves a transition zone in which most of the binder is removed, although enough is left adhering to the fibres where they cross one another to maintain the bonds between the individual fibres. Accordingly, the substantially binder-free zone can be made thicker.

If, by contrast, the binder-free zone is free from binder at the outset, it is best for the binder-free zone to be no thicker than 6 mm.

According to the invention, one process for producing the laminated mineral fibre mat according to the invention is characterised in that mineral fibres which have been sprayed with binder are first applied to a conveyor belt, a layer of binder-free mineral fibres is then deposited thereon, after which the conveyor belt is driven through an oven in which the binder hardens and the mat obtained, which is free from binder in its upper region, is laminated with a foil in known manner.

Another process according to the invention is characterised in that binder-free mineral fibres are applied to a metal foil coated with a hot-melt adhesive and heated to the melting temperature of the adhesive in such a way as to form a thin, mat-like layer which adheres to the hot-melt adhesive. The metal foil provided with the binder-free layer of mineral fibres is then brought into contact with the binder-containing fibre mat, an organic adhesive additionally being sprayed in, if desired, at that point at which the binder-free layer of mineral fibres comes into contact with the binder-containing mat.

Preferred production processes according to the invention start out from a binder-containing mat from which the binder is subsequently removed in that region where the lamination is applied.

Before it hardens in the mat, the binder may be dissolved out by means of solvents, after which the residues of binder are evaporated during hardening in the oven and the lamination subsequently applied.

The particularly preferred process according to the invention is characterised in that the surface of the mat is exposed to a flame before lamination so that most of the binder is removed from the surface region. Exposure to the flame may be carried out before or, preferably, after hardening of the binder. The advantage of this process is that it may readily be installed in existing production lines. In addition, the hot flame gases which penetrate into the mat appear to affect the adhering binder even in those regions where the binder is not removed in such a way as to provide the mat with favourable burning behaviour.

The processes for producing the mat according to the invention are described in detail in the following with reference to the accompanying drawings, wherein:

FIG. 1 diagrammatically illustrates a process in which a binder-free layer of fibres, to which the lamination is bonded, is applied to a binder-containing mat.

Figure 2:
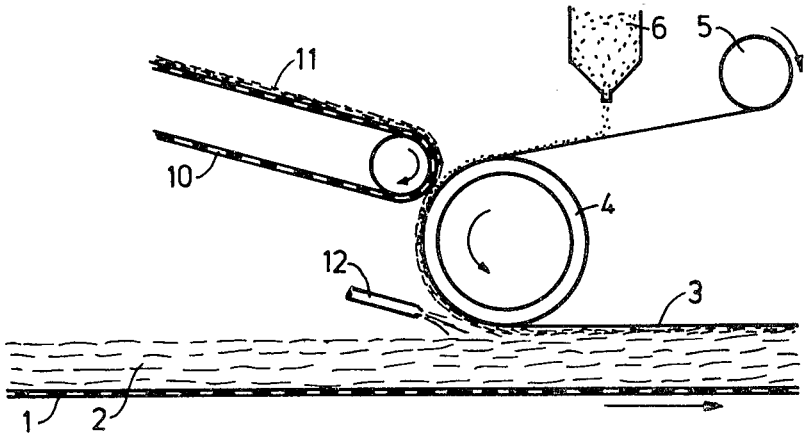

FIG. 2 diagrammatically illustrates the process in which binder-free fibres are initially bonded to the lamination, after which the lamination is applied with a layer of binder-free fibres to a binder-containing mat.

Figure 3:
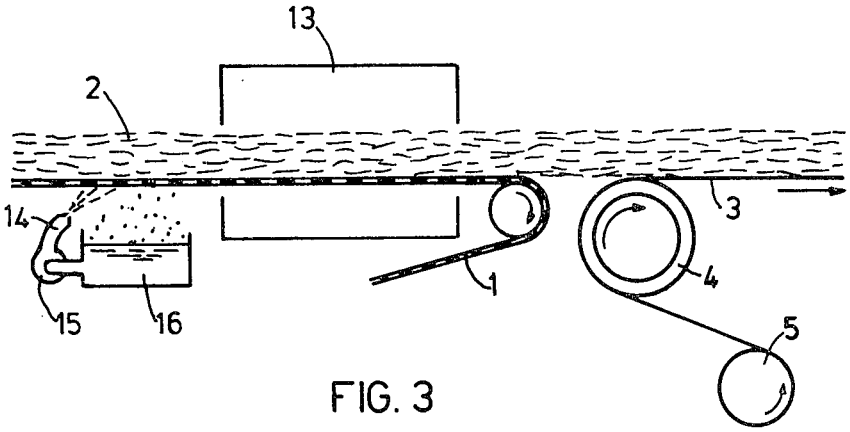

FIG. 3 diagrammatically illustrates the process in which the binder is dissolved out from the surface of a binder-containing mat and the lamination subsequently applied.

Figure 4:
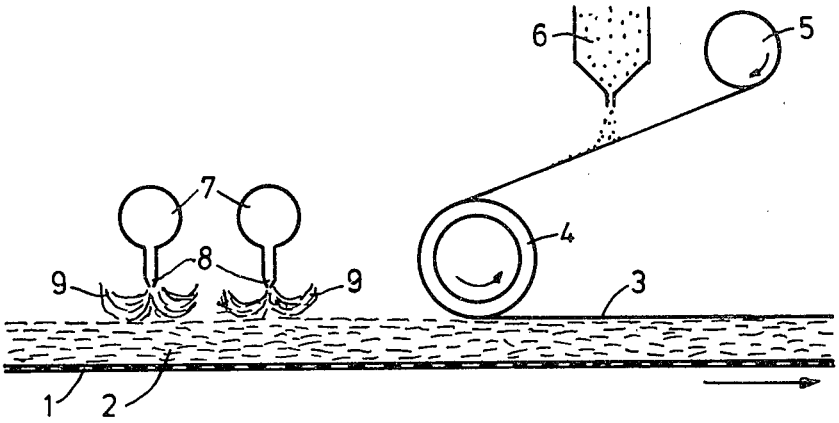

FIG. 4 diagrammatically illustrates, a particularly preferred process according to the invention in which the binder is burnt off from the surface by exposure to a flame before the lamination is applied.

The reference numerals used in the drawings have the following meanings, the same reference numerals in different drawings denoting comparable elements:

1 conveyor belt
2 binder-containing mineral fibre mat
3 lamination
4 heating roller
5 supply roll of laminating foil
6 organic adhesive for applying the laminating foil
7 fuel feed pipe
8 burner nozzle
9 flame
10 conveyor belt for binder-free fibres
11 binder-free fibres
12 adhesive spray
13 harding oven
14 solvent feed nozzle
15 solvent pump
16 collecting vessel for solvent In the process illustrated in FIG. 1 a binder-containing mat 2 approaches from the left on the conveyor belt 1. The mat 2 is formed in known manner, i.e. the mineral fibres are sprayed with binder after the fiberising process and deposited on the conveyor belt to form a mat. The formation of the mat 2 is not shown either in FIG. 1 or in any of the other figures. Above the mat 2, binder-free fibres are applied to the mat 2 by the conveyor belt 10. During this phase, some of the binder-free fibres 11 come into contact at one end with the binder-containing fibres of the mat 2 so that adequate cohesion between the layer of binder-free fibres and the binder-containing mat can be established. The mat is then passed through the hardening oven 13 in which the binder sets. A mineral fibre mat with a layer of binder-free fibres on top leaves the hardening oven 13. The laminating foil is applied in known manner. To this end, the hot-melt adhesive 6 is scattered over the laminating foil 3 from a storage container, after which the laminating foil is passed over a heated roller 4, as a result of which the hot-melt adhesive melts, and the laminating foil subsequently brought into contact with the mat. After the hot-melt adhesive has hardened, the laminating foil 3 adheres firmly to the mat 2.

In the process illustrated in FIG. 2, the binder-free fibres 11 are applied to the laminating foil 3 sprinkled with the hot-melt adhesive. Binder and/or hot-melt adhesive may be additionally sprayed in at that point at which the laminating foil carrying the binder-free fibres is brought into contact with the binder-containing mat 2, so that the binder-free fibres are bonded to the binder-containing mat.

In the preferred process illustrated in FIG. 3, the binder-containing mat 2 produced in known manner, in which the binder has not yet hardened, approaches from the left on the conveyor belt 1. Beneath the perforated conveyor belt 1, there is an assembly for spraying the mat with solvent and for collecting excess solvent. This assembly consists of a spray nozzle 14, a solvent pump 15 and a collecting vessel 16 for the solvent. The solvent circulates around the mineral fibres in the lower part of the mat, dissolving the binder. The solvent is able to flow away downwards through the perforated convey belt 1. Since the solvent becomes enriched with binder, it is continuously replenished with fresh solvent or replaced at regular intervals. The mat 2, from the lower part of which the binder has been dissolved out, is then delivered to a hardening oven 13 in which the binder sets and adhering solvent is removed. In this process, the laminating foil 3 coated with the hot-melt adhesive is applied from beneath, the hot-melt adhesive being melted by the heating roller 4.

The particularly preferred process according to the invention is illustrated in FIG. 4. The mineral fibre mat 2 leaving the hardening oven (not shown) is conveyed to the right on the conveyor belt 1, passing the flames 9 which burn off the binder from the surface of the mat. To this end, a fuel feed pipe 7 is provided transversely of the direction of movement of the conveyor belt 1, comprising underneath a plurality of burner nozzles 8 which extend transversely over the mat perpendicularly of the plane of the drawing. The laminating foil 3 is then applied by means of an organic hot-melt adhesive which is melted by the heating roller 4. The process illustrated in FIG. 4 readily lends itself to modification, for example for the lamination of mineral fibre mats on both sides. In this case, flames 9 are also generated on the underneath of the mineral fibre mat 2, burning off the binder from the underneath as well. The laminating foil is then simultaneously applied from beneath by means of an additional heating roller arranged below the mat.

EXAMPLE 1

Rock wool fibres produced by the cascade rotor process are sprayed with a phenyl-formaldehyde binder and deposited on a conveyor belt to form a mat. After the binder has set, the mat is laminated on one side with a 0.04 mm thick aluminum foil. A polyethylene-based hot-melt adhesive is used as the organic adhesive. The dimensionally stable mat obtained has a thickness of 33 mm and a density of 81 kg/m$^3$.

The mat does not satisfy the requirements of DIN 4102, Part 1, for classification in Fire Class A 2.

EXAMPLE 2

A laminated mineral fibre mat is produced in the same way as in Example 1 except that, before lamination, the mat issuing from the hardening oven is passed below a double row of natural gas flames, the binder being burnt off from the surface of the mat. Subsequent analysis showed that only about 10% of the binder content had been removed by the flame treatment. The thickness of the mat was reduced by 1.6 mm.

Testing in accordance with DIN 4102, Part 1, surprisingly resulted in classification in Fire Class A 1. It will be appreciated that the instant specification and examples are set forth by way of illustration and not limitation, and that various modifications and changes may be made without departing from the spirit and scope of the present invention.

We claim:

1. A laminated mineral fibre mat comprising substantially randomly arranged mineral fibres which are held together by organic binders where they cross one another and which form the mat and of a lamination adhering to the mat by means of an organic adhesive, characterised in that a plane of substantially randomly arranged mineral fibers substantially free from organic binder is provided in the mat parallel to and in the vicinity of the lamination.

2. A mineral fibre mat as claimed in claim 1, characterised in that the plane free from organic binder has a thickness of at least 2 mm and preferably at least 4 mm.

3. A mineral fibre mat as claimed in claim 1, characterised in that the organic binder is a phenol-formaldehyde resin.

4. A mineral fibre mat as claimed in claim 1, characterised in that the lamination is bonded to the mat by a polyethylene-based hot-melt adhesive.

5. A mineral fibre mat as claimed in claim 1, characterised in that the lamination consists of an aluminum foil.

6. A process for the production of the mineral fibre mat claimed in claim 1, characterised in that binder is removed from the mat of substantially randomly arranged mineral fibers in a plane parallel and adjacent to the surface to be laminated and thereafter the lamination is applied and adhered to the binder-free surface of the mat through use of an adhesive.

7. A process as claimed in claim 6, characterised in that, before hardening, binder is dissolved out by organic solvents.

8. A process as claimed in claim 6, characterised in that, after hardening, binder is removed by exposing the surface of the mat to a flame.

9. A process for producing the laminated mineral fibre mats claimed in claim 1, characterised in that a binder-containing mat is initially produced, a layer of binder-free fibres is subsequently applied to the mat, after which the binder in the mat is hardened and the lamination subsequently is applied and adhered to the layer of binder-free fibres through use of an adhesive.

10. A process for producing the laminated mineral fibre mats claimed in claim 1, characterised in that a layer of binder-free mineral fibres is bonded to the lamination before its application to the binder-containing mineral fibre mat, after which the lamination is applied to the binder-containing mat and bonded thereto, binder optionally being sprayed in at that point at which the lamination and the mat come into contact with one another.

* * * * *